United States Patent [19]

Branislav

[11] 4,201,146

[45] May 6, 1980

[54] DEVICE FOR RELIEVING THE RUDDER SHAFT IN SHIPS

[76] Inventor: Bilen Branislav, Kursulina 5, 11000 Beograd, Yugoslavia

[21] Appl. No.: 901,981

[22] Filed: May 1, 1978

[30] Foreign Application Priority Data

Jun. 6, 1977 [YU] Yugoslavia ..... 1401/77

[51] Int. Cl.[2] ..... B63H 25/06

[52] U.S. Cl. ..... 114/163; 114/144 R

[58] Field of Search ..... 114/144 R, 144 A, 144 C, 114/150, 162, 163, 171; 115/41 R, 41 HT, 18 R, 35, 37; 244/84, 83, 78; 74/480 B, 470, 471 R

[56] References Cited

U.S. PATENT DOCUMENTS 3,611,827 10/1971 Bottum et al. ..... 74/471 R 3,905,241 9/1975 Downing et al. ..... 244/75 R

*Primary Examiner*—Jesus D. Sotelo

*Attorney, Agent, or Firm*—Lawrence E. Laubscher

[57] ABSTRACT

Apparatus is disclosed for temporarily disconnecting from the steering mechanism of a ship one of a plurality of rudders that is in a jammed condition. Each rudder shaft is connected with the steering mechanism via a piston-cylinder motor that is supplied with pressure fluid via a supply system including at least one one-way valve. A safety valve is provided in the system for depressurizing the motor to disconnect the tiller member from the rudder shaft when the rudder is jammed and the pivotal force applied to the rudder by the tiller member causes the pressure fluid in the system to exceed the value determined by the safety valve.

2 Claims, 4 Drawing Figures

4

7
K
5
13
6
R
10
10
14
14
18
2
A
Return
4
11
12
9
3
3
8
8
8
8
B
Pressure Fluid Source
4

DEVICE FOR RELIEVING THE RUDDER SHAFT IN SHIPS

BRIEF DESCRIPTION OF THE PRIOR ART

The invention relates to a device for relieving the rudder shaft in ships having two or more rudders, when a rudder becomes jammed.

In ships having two or more rudders the steering means is firmly linked by levers with the rudder tiller. It delivers to the rudder the moment necessary for its motion, i.e. the moment necessary for overcoming the resistance opposing the motion of the rudder involved. If the resistance of a rudder increases considerably, for instance because of running aground on a sandbank, or because of a jammed tree stump, the total moment at the disposal of the steering means will be transferred to this rudder, while the other ones will be without load. In view of the fact that rudder shafts are dimensioned for a moment smaller than the one of the steering machine, in emergency operation an overloading of the shaft, with all its consequences, will ensue. The jamming of any of the rudders leads to the incapacitation of the whole system, so that the ship is unfit for navigation.

SUMMARY OF THE INVENTION

The apparatus of the invention serves for: (a) preventing the overloading of the rudder shaft; (b) increasing the resistance of the ship to damage; and (c) reducing the dynamic impacts on the shaft. The device described below will not allow overloading of the rudder shaft to occur, because if the moment on any rudder increases beyond a predetermined value it will open a safety valve and exclude the jammed rudder from the system. The exclusion of the jammed rudder from the system will allow the other rudders to perform their function undisturbed. This can be achieved because the tiller of the jammed rudder, after the operation of the safety valve, can turn freely and transfer motion to the adjacent non-jammed rudders.

BRIEF DESCRIPTION OF THE DRAWING

The device of the invention is shown on the enclosed drawings, in which.

DETAILED DESCRIPTION

Figure 1:
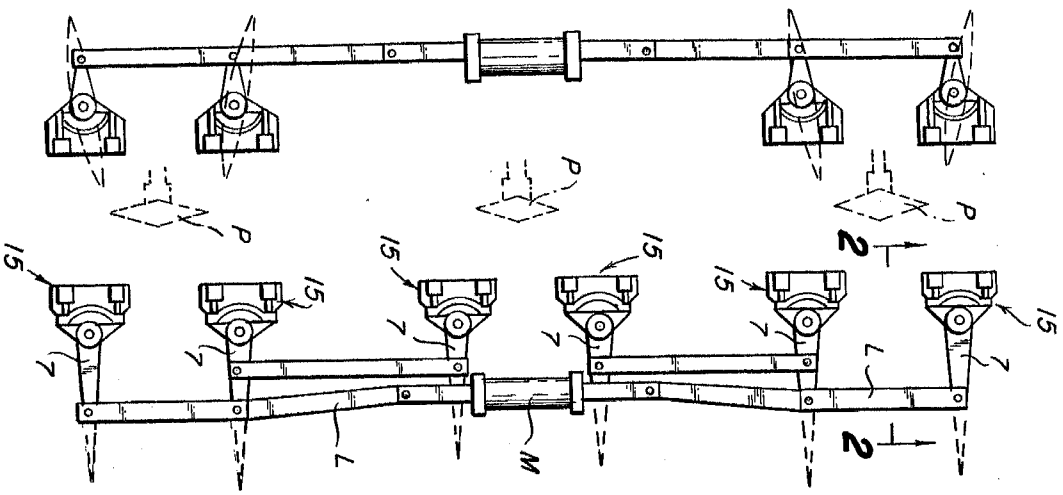
FIG. 1 is a diagrammatic illustration of the steering system of a ship having a plurality of rudders.
Figure 2:
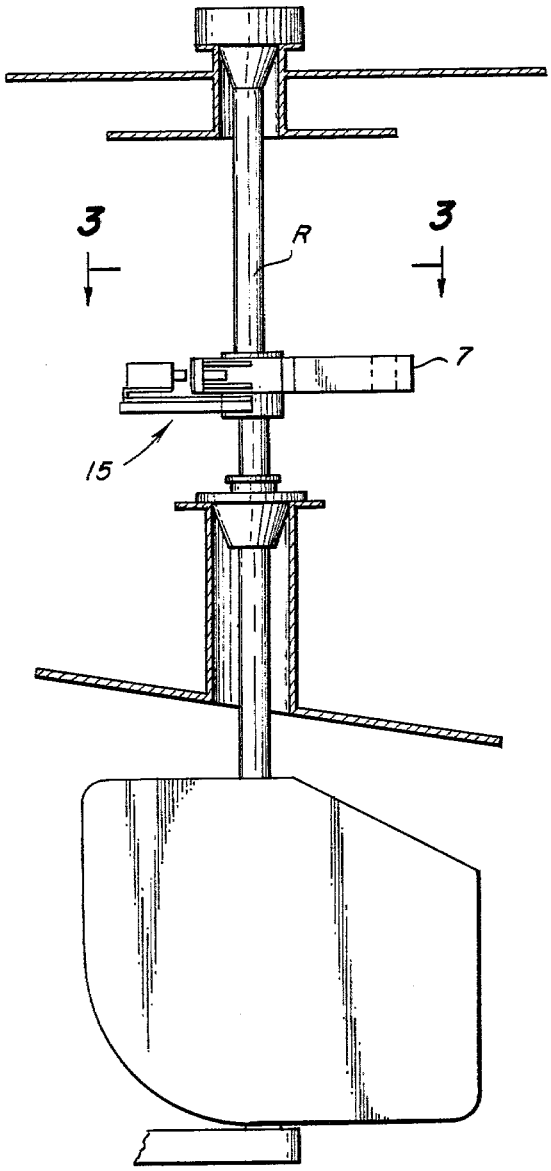
FIG. 2 is a detailed sectional view taken along line 2—2 of FIG. 1.
Figure 3:
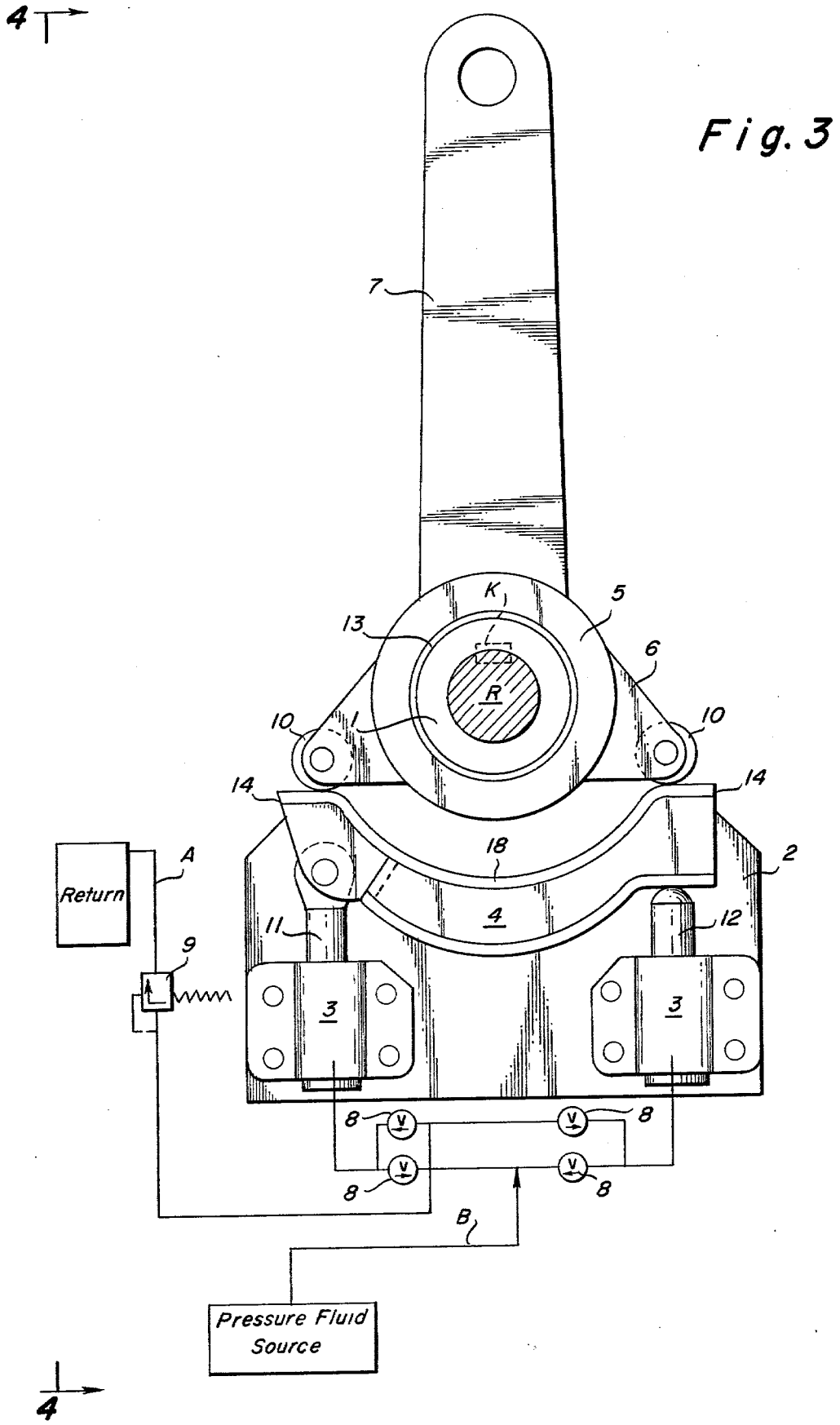
FIG. 3 is a sectional view taken along line 3—3 of FIG. 2.
Figure 4:
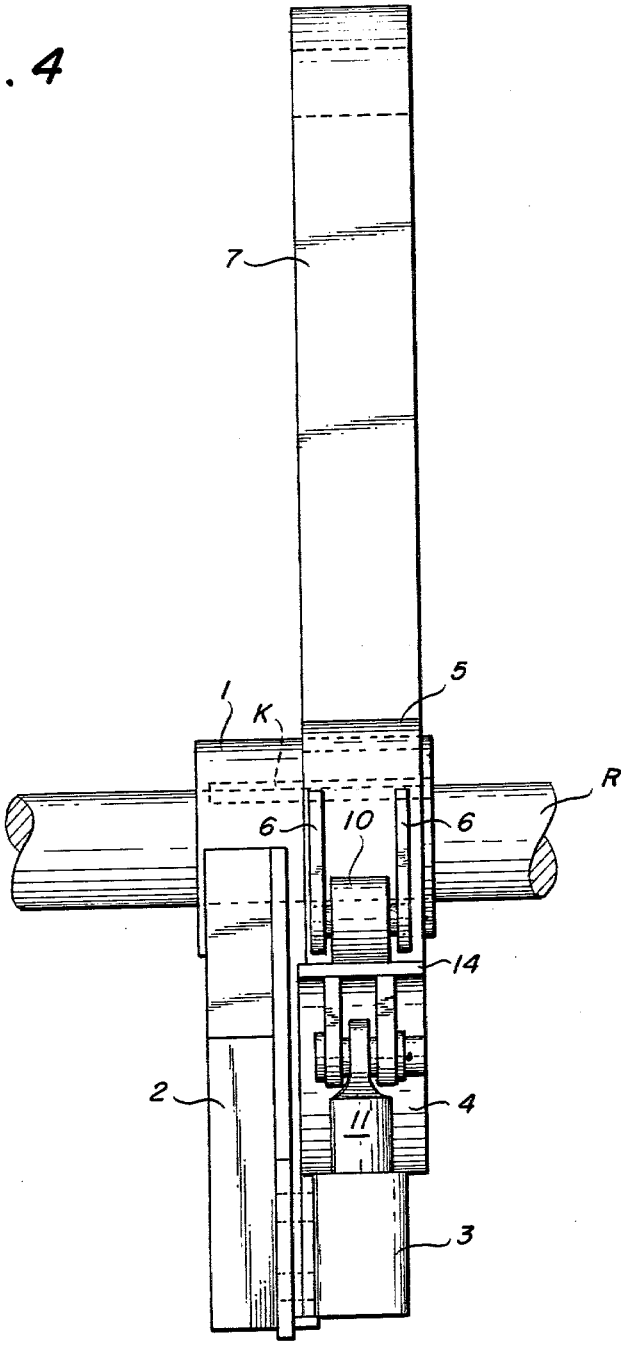
FIG. 4 is a sectional view taken along line 4—4 of FIG. 3.

As shown in FIGS. 1 and 2, the steering means of the ship includes master steering mechanisms M for steering the rudders arranged for and aft of the ship propellers P, these mechanisms being connected with the various tiller members 7 by connecting links or levers L. In accordance with the present invention, the tiller members 7 are connected with their respective rudder shafts R via the pressure-responsive releasable connecting devices 15 of the present invention. Each of the releasable devices 15 includes hub 1 keyed by key K on the rudder shaft R, to which hub a plate 2 is welded. Oil cylinders 3 are fastened on plate 2, for example with bolts. Piston rod 11 of one of the oil cylinders 3 is articulated on guide 4, while the other piston rod 12 rests on guide 4. The wheels 10 of stirrup 6 are pressed against and move on guide 4. Stirrup 6 is firmly fixed to the sliding ring 5, freely mounted on hub 1. Tiller 7 is connected with the sliding ring 5. Oil cylinder 3 are provided with a common supply duct B and with a common return duct A. One-way valves 8 prevent the circulation of oil from one cylinder to the other. The relieving duct is connected with the safety valve 9, and beyond the latter with the oil tank of the steering means M of FIG. 1. The supply duct B is connected through the two one-way valves 8 with the master cylinder of the steering means.

OPERATION

In the operation of the device 15 of the invention, the steering means transmits the assigned motion to tiller 7. Tiller 7 actuates the sliding ring 5 and the stirrup 6. The stirrup 6, through guide 4 and oil cylinders 3, actuates the hub 1. Finally, hub 1 actuates through key means K the rudder shaft R. In normal operation, no relative motion of cylinders and their pistons takes place. The pistons of the cylinders, owing to oil pressure in the latter, have been pushed to their outermost position. This outermost position of the pistons is also a measure of the mutual positions of hub 1 and of sliding rings 5, and of the zero position of the rudder.

If one of the existing rudders has become jammed and is unable to perform the assigned motion, the case of emergency operation takes place. In emergency operation, the steering means actuates tiller 7—the helmsman assigns the motion that corresponds to the assigned angle because he is not aware that emergency operation has begun. The tiller will, as in the case of normal operation, actuate the sliding ring 5 and the stirrup 6, but the wheel of the said stirrup will encounter a blocked guide 4. The stirrup, being unable to move the said guide, will begin thrusting down the pistons 11 and 12 into the cylinders, thus increasing the oil pressure beyond the pressure to which the safety valve 9 has been set. The said safety valve will open and the oil, under piston pressure, will be discharged from the cylinders, thus allowing the pistons to enter into the cylinders and reach therein their innermost position. The length of oil cylinders 3 is selected to permit a rotation of the sliding ring 5 for about $\pm 10°$. Beyond this angle, if the assigned motion of the rudder is bigger, the stirrup wheel 10 will slide into guide 4, so that the sliding ring 5 will be able to travel along the whole assigned path, despite the fact that the blocked hub 1 has remained in its initial position. When the cause that has jammed the rudder has been removed, and the sliding ring 5 has been brought into zero position in relation to hub 1, the cylinder pistons which had been pushed down will return to the working position, under the action of the oil pressure from the cylinders of the steering means.

The moment on the rudder shaft is not static, but is a variable value of complex frequencies and of an amplitude in the range between 15 and 20% of the nominal moment. The presence of the oil cylinders, practically representing a damper, will lead to a more advantageous picture of the shaft load.

The device of the invention will contribute to a reduction of the material and of the time used for repairing the steering device, which will have as a consequence more navigation hours and smaller maintenance costs, and also a reduction in the dimensions of both the shaft and the rudder bearings, leading to a reduction in the weight thereof, and consequently to a reduction of the building costs.

This invention is not limited by the above description, In fact, many modifications are possible, such as, for example, the one with several hydraulic cylinders and pistons, and the like.

I claim:

1. Apparatus for disconnecting from the steering mechanism of a ship one of a plurality of rudders when the rudder is in a jammed condition, each of said rudders having a generally vertical shaft, comprising (a) an annular hub member (1) adapted for mounting in keyed relation concentrically about said one rudder shaft;

(b) a plate (2) rigidly secured to and extending normal to the axis of said hub member;

(c) a pair of pressure fluid piston-cylinder motors (3) mounted in spaced parallel relation on said plate, the axes of said motors being parallel to said plate and being arranged on opposite sides of, and parallel to, a first plane which is normal to said plate and which contains the longitudinal axis of said hub member, the piston rods (11, 12) of said motors extending generally in the direction of said hub;

(d) a guide member (4) pivotally connected at one end with the free end of one (11) of said pistons, said guide member being generally parallel with said plate and being spaced from said hub member, the other end of said guide member being in engagement with, and supported by the free end of, the other (12) of said pistons, the face (14) of said guide member adjacent said hub member being planar and normal to said first plane, said guide member planar face containing adjacent its center a semi-circular recess (18);

(e) an annular tiller ring (5) rotatably mounted concentrically about said hub member, said tiller ring including a stirrup portion (6) carrying a pair of rollers (10) adjacent the planar face of said guide member on opposite sides of said recess, respectively;

(f) a tiller member (7) rigidly connected with said tiller ring;

(g) means including one-way valve means (8) for normally supplying pressure fluid to said motors to force said piston rods and said guide member toward said hub member to a position in which said rollers engage portions of said planar guide surface on opposite sides of said recess, whereby pivotal movement of said tiller member is conducted to said hub member via the engagement between said rollers and said guide plate; and (h) pressure-responsive safety valve means (9) for releasing pressure fluid from said motors when the fluid pressure thereof exceeds a predetermined value, whereby in the event that the rudder is in a jammed condition, pivotal movement of the tiller member causes operation of the safety valve means to vent the motors to disable the guide member relative to said rollers.

2. Apparatus as defined in claim 1, and further including an annular bearing sleeve (13) arranged concentrically between said hub and said tiller ring.

* * * * *

UNITED STATES PATENT AND TRADEMARK OFFICE

CERTIFICATE OF CORRECTION

PATENT NO. : 4,201,146

DATED : May 6, 1980

INVENTOR(S) : Bilen Branislav

It is certified that error appears in the above-identified patent and that said Letters Patent are hereby corrected as shown below:

Cover page, Item [76], please change "Bilen Branislav" to read:

-- Branislav J. Bilen -- .

Signed and Sealed this

*Fourteenth* Day of *September 1982*

[SEAL]

*Attest:*

GERALD J. MOSSINGHOFF

*Attesting Officer*

*Commissioner of Patents and Trademarks*